United States Patent [19]

Torterotot et al.

[11] 4,444,610

[45] Apr. 24, 1984

[54] METHOD AND APPARATUS FOR PROVIDING PIERCING TABS ON THE LIDS OF CONTAINERS

[75] Inventors: Roland Torterotot, Longvilliers; Jean C. Hautemont, Gif sur Yvette, both of France

[73] Assignee: S.A.R.L. Eroa Holding, Les Ulis, France

[21] Appl. No.: 362,513

[22] Filed: Mar. 26, 1982

[30] Foreign Application Priority Data

Mar. 27, 1981 [FR] France ..... 81 06252
May 29, 1981 [FR] France ..... 81 10727

[51] Int. Cl.[3] ..... B32B 31/04; B65D 41/32

[52] U.S. Cl. ..... 156/264; 53/133; 53/412; 156/267; 156/512; 156/517; 156/521; 156/529; 206/601; 206/603; 220/267; 220/270; 220/277

[58] Field of Search ..... 18/196, 264, 267, 512, 18/517, 521, 559; 53/132, 133, 158, 296, 381 R, 382, 410, 412, 450, 451, 456, 485, 486; 206/601, 603, 816, 613; 220/260, 271, 265, 267, 268, 269, 270, 277, 278

[56] References Cited

U.S. PATENT DOCUMENTS

| | | | |
|---|---|---|---|
| 2,642,203 | 6/1953 | Seemuller | 220/277 |
| 3,289,880 | 12/1966 | Wilkich | 220/277 |
| 3,371,818 | 3/1968 | Bozek | 220/267 |
| 3,851,441 | 12/1974 | Marchand | 53/133 |
| 4,130,219 | 12/1978 | Mallorca | 220/270 |
| 4,205,760 | 6/1980 | Hasegawa | 220/271 |
| 4,331,256 | 5/1982 | Helms | 220/270 |

*Primary Examiner*—Caleb Weston
*Attorney, Agent, or Firm*—Staas & Halsey

[57] ABSTRACT

This piercing device for lids constituted of a supple and tearable material includes a substantially plane rigid tab on which a pivoting axis is provided, which axis divides the tab into a piercing arm and a handling arm and is fixed on the lid.

In order to produce this axis, there is provided a supple tab having about the same extension as the rigid tab, the supple tab being secured by one face to the rigid tab and by the other face to the lid, at least on the side of the handling arm of the rigid tab.

This device is particularly designed to be produced in association with an installation for thermo-shaping, filling and sealing thermoplastic containers.

8 Claims, 12 Drawing Figures

Fig. 8
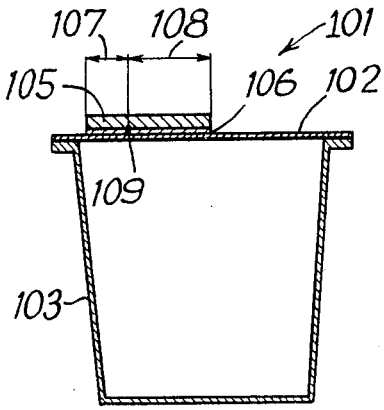
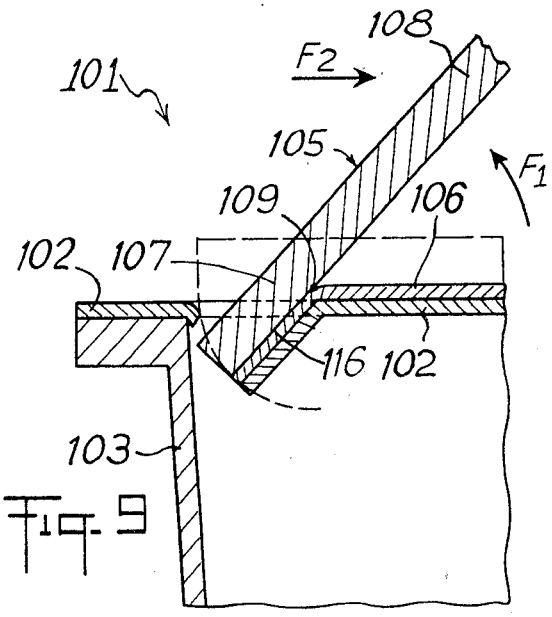
Fig. 9
Fig. 10
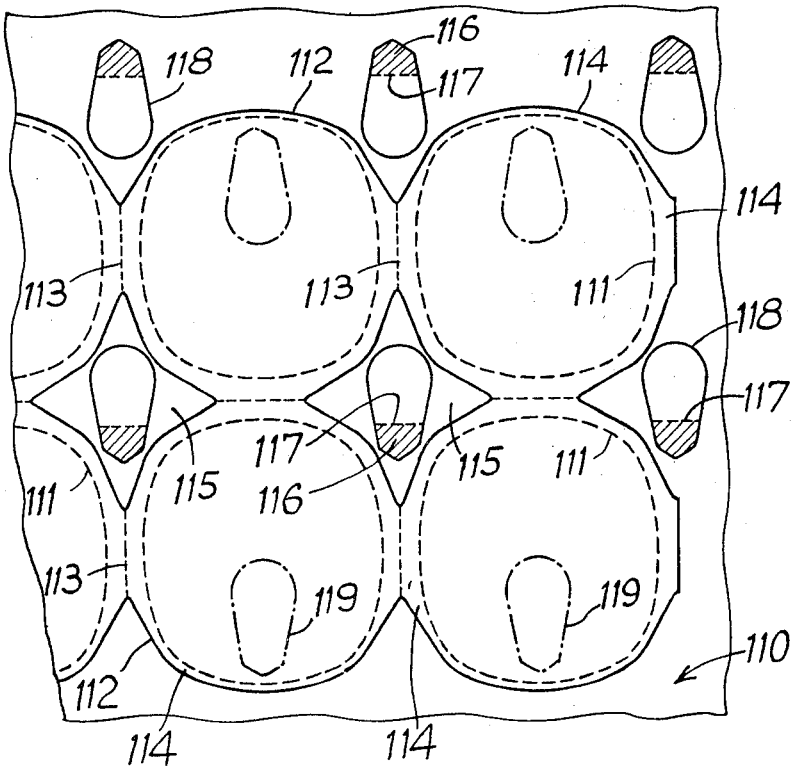

120
123
124
137
130
133
131
136
132
138
139
140
F1
135
134
103
125
126
127
122
128
129
110
111

112
110
136
133
105,106
115
134
134
120
114
116
121
110
103

METHOD AND APPARATUS FOR PROVIDING PIERCING TABS ON THE LIDS OF CONTAINERS

BACKGROUND OF THE INVENTION

The present invention relates to a method for providing piercing tabs on container lids, said tabs working by a leverage effect, and the lids being produced from a supple and tearable material.

Many devices are known for opening lids.

For example, lids have been proposed which comprise frangible score lines and are equipped with an element which is grasped and pulled to break the lid open along the frangible score lines. This opening system is generally awkward and requires a score line which is incompatible with the preservation of certain products (oxidation and/or bacteriological contamination, level with the base of the score lines, for example, may occur whenever the base of said line touches an oxidizable and/or nonsterile layer of a surface-sterilized multilayer lid).

Another solution has been proposed which consists in pre-perforating a hole in the lid and covering it with an easily removable adhesive element. But this system is not really satisfactory either where the preservation of certain products is concerned.

A system using a peelable lid has been very favorably received by the producers as well as by the consumers. Normally associated with a thermo-shaped container production installation, this system has led to a reliable and inexpensive opening system.

Nonetheless, there are products for which this last system cannot be used, in particular for long-term packagings or packagings of a sterile nature which require perfect tightness at the level of the lid, this being only obtained by auto-welding sealings which therefore are not peelable.

Lid-opening devices are also known from French Pat. No. 2 241 466 using piercing tabs by leverage, but on the one hand, the tabs are bonded flat directly on the lids, which are made of relatively rigid plastic material, and on the other hand said opening devices are necessarily associated with a lid comprising frangible score lines and make the opening more by shearing the lines than by really piercing the lid. These known devices have the disadvantage of either not giving to the tab a definite articulation, in which case the device works badly or else the tab can even detach itself from the lid, or requiring the presence on the lid proper of means independent of the tab and giving the latter a definite articulation. But, in this latter case, the production of these extra means—when it is possible—complicates and slows up the production line of the sealed containers; in addition, this makes it necessary afterwards to place the tabs in a very accurate position predetermined in relation to said extra means, which is not always easy and compatible with a high rate of production.

SUMMARY OF THE INVENTION

It is the object of the present invention to propose a new type of device which is simpler to open, and inexpensive to produce, and can be adapted to many types of lids and in particular those generally used in an installation producing and packaging thermo-shaped containers with welded lids, with none of the aforesaid disadvantages. The producing and packaging installations which are particularly concerned here are of the type known as F.F.S. (abbreviation for: Forming, Filling, Sealing).

The object of the invention is reached by the fact that:

(1) the tabs produced are substantially plane and rigid, (2) a pivoting axis is provided on the tabs, dividing said tab into a piercing arm and a handling arm, and (3) the pivoting axes are fixed on the lids.

The invention further relates to a piercing device constituted by a substantially plane tab on which is provided a pivoting axis which divides the tab into a piercing arm and a handling arm; the axis being secured to the lid.

The invention also relates to an installation for producing a piercing device, comprising means for producing substantially plane tabs, means for providing on said tabs a pivoting axis which divides the tabs into a piercing arm and a handling arm, and means for securing the axes on the lids of the containers.

According to a first embodiment of the invention, the pivoting axis is provided by a rib on the tab.

The piercing device comprises a substantially plane tab, provided on one of its faces with a rib fixed on the upper face of the container lid, said rib separating the tab into two arms, a handling arm and a piercing arm, respectively, so that the lifting by hand of the handling arm causes, firstly, the pivoting of the tab about the rib and the piercing of the lid by the piercing arm, and secondly, the tearing up of part of the lid starting from the pierced portion.

With the device according to the invention, it is quite possible to do away with score lines. But they can of course be used if it is preferred to obtain a tear along a given line or when the lid is particularly thick.

The opening system according to the invention shows other advantages besides its simplicity: it does not require any strong and/or sharp movement (which could accidentally cause the product inside the container to spill out); if the tab is only slightly pulled, the container can temporarily be closed again by the tab being replaced on the lid; and since the tab can be pulled and remain attached to the partly torn lid, there is no separate element which could create pollution if thrown away.

Advantageously, the rib is formed integrally with the tab. To be more precise, it is constituted by a deformation of said tab obtained, for example, by stamping.

Advantageously, the operating arm comprises, on the face of the tab facing the lid, a clearing lug to facilitate the gripping of the tab.

Advantageously, the lid is made of an aluminium-containing material and in particular from a polyethylene/aluminium, or polypropylene/aluminium or similar composite material.

It is advantageous, when producing thermo-shaped containers from a thermoplastic strip, with welded lids and cut out from said strip, to form the piercing tabs in the thermoplastic strips used for the containers.

Advantageously, the tabs are cut out from the thermoplastic strip in the free areas situated between the container-shaping areas.

Advantageously, the tabs are cut at the same time as the containers.

An installation for producing the device according to the invention, within an installation for packaging containers thermo-shaped from a thermoplastic strip, and provided with a welded lid and cut out at a cutting station, comprises means for forming the ribs, means for cutting the tabs, means for grasping and transferring said tabs to a station where they are coated with adhesive, means for transferring the tabs from the adhesive-coating station to the lids of the containers, and means for applying the tabs on the lids.

According to another even more advantageous embodiment of the invention, the pivoting axis of the rigid tabs is provided by contiguously providing said tabs with a supple tab having approximately the same extension as the rigid tabs, secured on one face to the rigid tabs on the piercing arm side only, and on the other face to the lids, at least on the side of the rigid tab-handling arm.

In this way, the pivoting axis of the rigid tab on the lid is provided by the dividing line between the part of the supple tab which is secured on the rigid tab, and the part of the supple tab which is free with respect to the rigid tab but secured on the lid. By pivoting the handling arm of the rigid tab upwards, the piercing arm of said rigid tab necessarily pivots downwards, tearing the lid in that particular spot and through to the pivoting line. And then by pulling the rigid tab towards the back end of the supple tab fixed to the lid, the lid is torn at the same time along lines following more or less the edges of the supple tab. Thus, there is no need either in this embodiment to provide the lid with score lines or tearing lines.

The means generally used for securing the supple tab to the rigid tab and/or to the lid is a hot adhesive, or a lacquer or a thermo-bonding varnish or any other adhesive substances.

Although the lid can be produced from any type of tearable material, it is advantageously produced from a metallic sheet, such as aluminium, with if necessary a thermo-bonding film.

The rigid tab and the supple tab may be produced from any suitable materials but when the containers are produced from a thermoplastic sheet and the lids from an aluminium strip with, if necessary, a thermo-bonding film, it is advantageous to produce the rigid tabs from the thermoplastic strip and the supple tabs from the aluminium strip.

In this case, it is recommended to use for producing the rigid tabs and the supple tabs the areas from the thermoplastic strip and from the aluminium strip which are situated between the curvilinear or rounded rims of the thermoplastic containers when said containers are cut from the container strip and from the lid strip.

To this effect, it is possible, when sealing the lid strip over the edges of the filled containers still attached to the container strip, to seal a part of the lid strip, which part corresponds to that of the supple tab which is meant to be secured to the rigid tab, and then, preferably, after causing the sealed containers to go forward at least one step, the rigid and supple tabs are cut together from the mainly star-shaped areas between the rims of the containers which at that time are only partly cut from the containers-strips/lids-strip assembly, the area where the superimposed rigid and supple tabs are cut being so selected that it coincides with the primary sealing area which should then correspond to the piercing arm of the cut out rigid tab.

Obviously, the cut out and sealed rigid and supple tab assemblies are collected and preferably, the face of the supple tab which is non-adjacent to the rigid tab, is entirely bonded on the cover of a sealed container in the area situated plumb with the opening of a container. Preferably, the supple tab is bonded on the lid—which is made of the same material as the latter—so that the piercing arm of the rigid tab is situated adjacent the edge and possibly adjacent a corner of the opening of the container.

For bonding the supple tab on the lid, it is possible to coat the free external face of said tab with a suitable adhesive and then to apply the assembly, consisting of the rigid tab and of the supple tab with the adhesive-coated face, on the corresponding lid, but it is also possible to coat with adhesive the area of the lid which is meant to receive the free face of the supple tab, which by its other face is firmly bonded with the piercing arm of the rigid tab.

An installation for producing the piercing device, which consists of a supple tab and a rigid tab, one on top of the other, can comprise means for sealing a supple tab on a rigid tab in areas corresponding subsequently to the piercing arms of the different rigid tabs, means for cutting superimposed rigid and supple tabs, means for transferring the cut out and sealed assemblies of supple and rigid tabs between the cutting station and the spot where they are placed on the lids of the sealed containers, means for coating with adhesive either the free face of the supple tab or the area of the lid meant to receive the rigid and supple tabs assembly, as well as means for applying the assemblies on the corresponding lids so that the free face of the supple tab is firmly bonded with the lid.

When applying the piercing device to thermo-shaped and thermo-sealed containers, it is possible to advantageously integrate the different means of the installation producing the piercing devices to a packaging installation of the F.F.S. type, namely an installation where the containers are thermo-shaped from a thermo-plastic strip, where said containers are filled with a product and are sealed with a lid strip and where finally the sealed containers are cut out from the thermoplastic strip and from the lid strip.

In this case, the station where the lid strip is sealed on the thermoplastic container strip also comprises means for sealing the supple strip on the rigid strips, and means for cutting out the rigid and supple tab assemblies can be provided either in the station where the sealed containers are partly cut, or just upstream thereof.

BRIEF DESCRIPTION OF THE DRAWINGS

The invention will be more readily understood on reading the following description with reference to the accompanying drawings in which:

FIG. 8 is a cross-sectional view of a container wherein the lid is equipped with a second embodiment of the piercing device according to the invention;

FIG. 9 is an enlarged view of the device shown in FIG. 8 but in the piercing position.

FIG. 10 is a plan view of a lid strip sealed on a thermoplastic container strip, said figure showing the cutting outlines of the containers and of the tabs, in a second embodiment of the invention;

DESCRIPTION OF THE PREFERRED EMBODIMENTS

Figure 1:
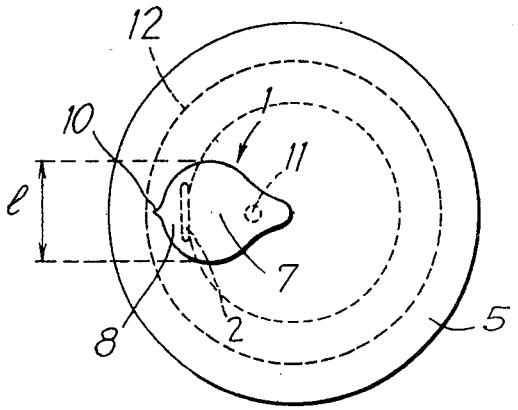
FIG. 1 is a plan view of a container and of its lid equipped with a first embodiment of the piercing device according to the invention.

The first embodiment of the piercing device according to the invention (FIGS. 1 to 7) comprises a substantially plane tab 1 which is provided with a pivoting axis in the form of a rib 2 on one 3 of its two faces.

Said tab 1 is bonded in the rib area by way of a soft-setting adhesive 4 on the lid 5 of a container 6.

The rib 2 separates the tab 1 into two arms: a handling arm 7 and a piercing arm 8.

Figure 3:
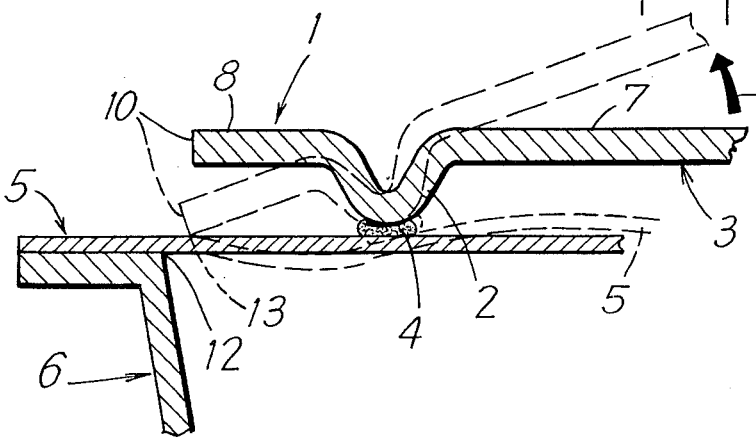
FIG. 3 is an enlarged detail of the device according to FIG. 2.

By raising the handling arm 7 of the tab 1 upwards (arrow 9 in FIG. 3), said tab 1 pivots about the rib 2 so that the end of the piercing arm touches the lid 5 (FIG. 3, position indicated in broken lines). This pivoting movement is possible because of the suppleness of the lid 5 which sinks in slightly and possibly because of the softness of the adhesive 4.

When continuing to raise the handling arm upwards, the end of the piercing arm 8 sinks into the lid 5 and pierces it. The end of the piercing arm 8 is angular (pointed end 10) to facilitate this operation.

When continuing to pivot the tab 1 about the rib 2 until it is in a position substantially perpendicular to the plane of the lid 5, the piercing arm widens the tear of the lid until this reaches substantially the width 1 of the tab 1 at the level of the rib 2. The design of the piercing arm 8 widens progressively from the point 10 towards the rib 2 so as to facilitate the progressive widening of the tear.

Once the lid has been pierced and torn over the width 1, it suffices, to extend the opening, to pull the tab 1 by way of the handling arm 7 in the direction opposite the piercing arm, so as to continue the tearing.

The tearing continues generally over the width 1. This operation is particularly easy if, in the case of a composite lid comprising a plastic material, the tearing is effected in the direction of extrusion of the plastic; it is therefore recommended in such a case to place the tab so that its rib 2 is perpendicular to the direction of extrusion of the plastic film.

Of course, if the lid is provided with frangible score lines, the tab may be placed so that, during the pivoting movement thereof which causes the piercing and initiates the tearing of the lid, the tearing comes up to the score lines and, by pulling the tab further, the tearing proceeds along the scoring lines. These can be designed so that an annular tear is obtained all around the lid, thus permitting to remove said lid virtually completely.

The rib 2 of the tab 1 can be constituted by an added member secured on the tab; or it can be constituted by the bead of adhesive 4 proper if this is not to thick.

Preferably, the rib 2 is formed in one piece with the tab 1 and may be, in the case where the tab is made of plastic material, a simple deformation (FIG. 3) obtained by hot or cold stamping.

The height of said rib 2 is not really important; it can be equal to 1 or 2 mm for example. The height of the rib and the length of the piercing arm determine the angle under which the point 10 of the piercing arm 8 attacks the lid 5, which angle affects the facility of the piercing.

In order to pierce the lid 5 easily by hand said lid is equipped on its face 3 with a distance piece 11 which can be formed like the rib 2 by stamping.

Figure 2:
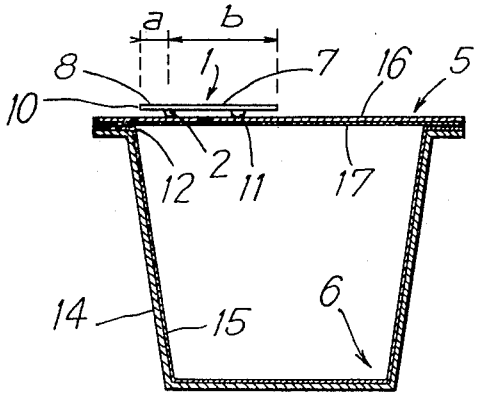
FIG. 2 is a front view of the container shown in FIG. 1.

Said distance piece 11 may be slightly bonded to the lid so as to oppose an accidental rising of the handling part 7 which would cause the piercing of the lid. Such bonding, however, should be light enough to give in when the user pulls intentionally on the tab 1 manually. Although the tab 1, which can be any size depending on the type of openings to be made, can be placed in many different parts of the lid, it is advantageous to place it, as illustrated in FIGS. 1 to 3, so that the end 10 of the piercing area 8 is situated in the immediate vicinity of the edge 12 of the rim of the container 6 on which is placed the lid 5. In this way, when the tab 1 has pivoted and the point 10 starts to attack the lid 5, the point 13 where the piercing is initiated is very close (between 1 and 3 mm for example) to the edge of the rim of the container and as a result, that part of the lid is supported by the presence of said rim and hardly deformed, and the piercing is thus easier (shearing effect).

The invention is applicable to any types of lids peelable under the action of a rigid corner piece and the peeling of which can also be extended by pulling on the torn part.

More particularly, the invention can be used for opening thermo-shaped containers with nonpeelable thermo-sealed lids. This is the case, for example, with containers thermo-shaped from a strip of polystyrene 14/polyethylene 15 composite material provided with a composite lid of aluminium 16 and polyethylene 17 sealed by auto-welding on the rims of the container.

With such containers, it is especially advantageous, whenever the design selected for the tabs 1 allows it, to form the tab in the strip of thermoplastic material 18 (FIGS. 4, 5) from which the containers are made, and especially in the star-shaped spare pieces (FIGS. 4, 5) between the containers.

There now follows a description (FIGS. 4–7) of an example of production and positioning of the tab 1 within a conventional installation for packaging the thermo-shaped containers wherein downstream of a whole line of stations where the thermo-shaping, filling and lid strip sealing operations are conducted, a station 19 is provided where the containers are cut.

The containers are cut out in a known manner with dies or punches, not shown, over the entire length of the strip 18, two containers at a time for example. Such techniques are known by those skilled in the art and will not be described in more detail.

The tabs 1 are advantageously formed in the star-shaped areas situated between the containers at the level of the station 19 where the containers are cut. At this level, the strip 18 carries the thermo-shaped containers 6 and is covered with the lid strip (made of aluminium/-polyethylene composite for example); therefore, by being cut at said station 19, the tabs 1 will be formed by a structure comprising, on the one hand, the said thermoplastic composite and, on the other hand, the lid strip, this permitting, by suitable printing of the strip, entry on the tab 1 of all the required indications (such as arrows or coded instructions for opening) or any type of printed design.

In order to cut the tabs 1 simultaneously with the containers 6, the lower cutting tool 20, used for cutting the containers 6, is provided with projecting punches 21, having the shape of the tabs 1, and situated in the areas between the containers. Said punches 21 cooperate with stamping dies 22 whose inlet section corresponds to the section of the punches 21 to allow the cutting by shearing of the tabs 1. The latter have already been stamped in at the container-shaping station to form on their surface the rib 2 and the piece 11, so that perfectly shaped tabs pile up as they are cut inside the dies 22 (said piling up of the tabs 1 is only shown on the righthand die of FIG. 6).

To limit friction between the tabs and the walls of the dies, and to avoid jamming up, the walls of the die are, generally speaking, wider than at the level of their inlet section.

The tabs 1 are taken, at the outlet from the dies 22, by guide means 23 which can, for example, be made up of several filiform guides enclosing the tabs, which tabs may be especially designed to this effect, with concave edges, and even notches, to facilitate guiding by this type of guiding means.

At the outlet from the guide means 23, each tab is picked up by a resilient clamp 24 mounted on a drum 25 rotating about an axis 26 perpendicular to the forward direction 27 of the strip 18.

Figure 7:
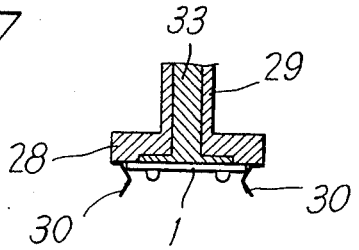
FIG. 7 is a resilient clamp used in the installation shown in FIG. 6.

Said elastic clamps can be composed as illustrated in FIG. 7, by a plate 28, supported by a foot 29 adapted to slide so as to be retracted, to a greater or lesser extent, inside the drum 25. The plate 28 is provided with resilient holding members 30, allowing a tab 1 to clip on and rest against the tray 28.

During a rotation of the drum 25, the tabs 1 pass in front of an adhesive-coating station 31 where the ribs 2, (and the distance pieces 11, if any) are coated with adhesive.

Having turned over a suitable angle, the clamps 24 bring the tabs 1 onto the lids of the containers **6*a*, 6*b* situated above the picking-up belt 32 by way of a driving-out rod 33 mounted for sliding in each clamp 24**.

Figure 5:
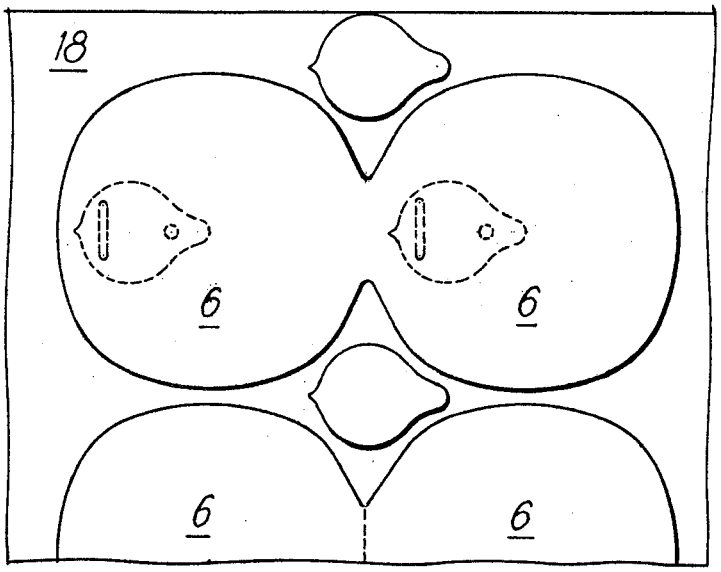
FIG. 5 is an enlarged detail of FIG. 4.
Figure 4:
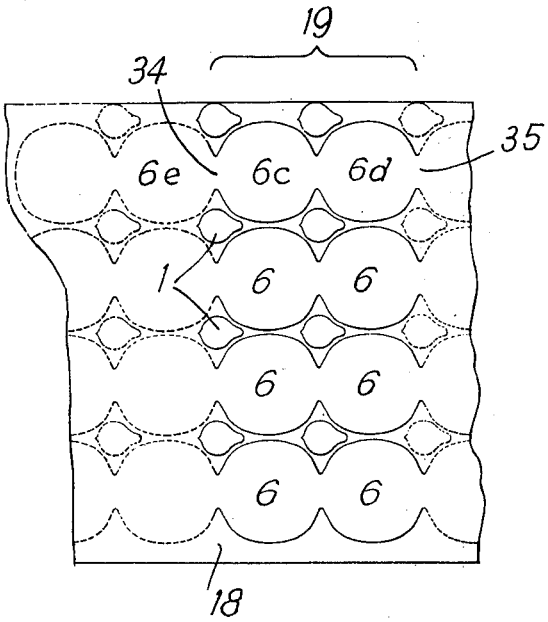
FIG. 4 is a plan view of the containers formed in a strip of thermoplastic material and showing where the tabs of the first embodiment are cut.
Figure 6:
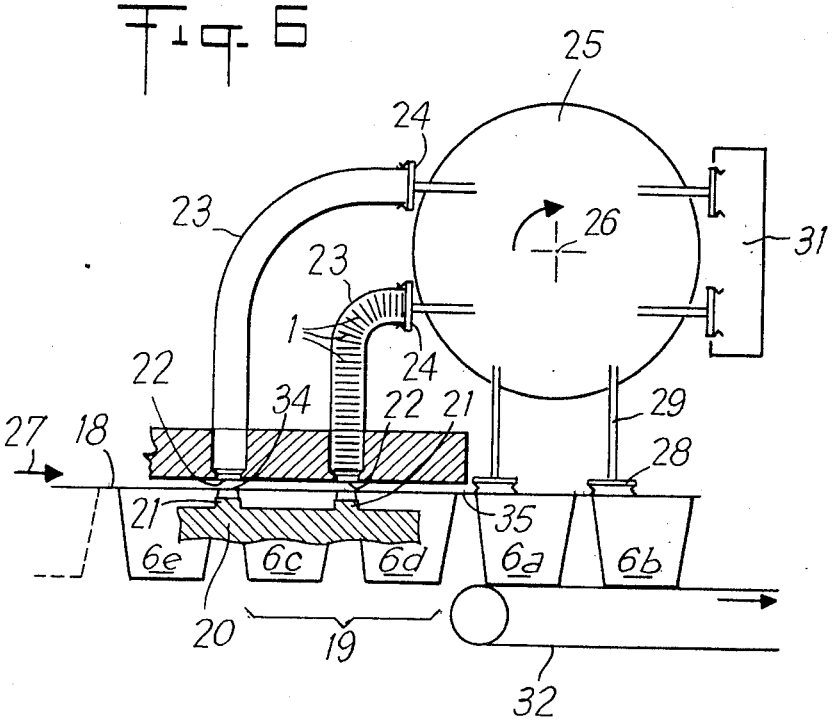
FIG. 6 is a diagrammatical lateral view of part of an installation for producing the first embodiment of the device according to the invention.

It is to be noted that, as can be seen in FIGS. 4 and 5, the tabs are picked up in the areas between the containers and deposited in spots which are normally shifted sideways with respect to the picking-up areas. Therefore, it is important to account for this lateral shifting either at the level of the guide means 23 or with a device associated with the clamps 24, allowing them, when the drum 25 is rotating, to be slightly shifted sideways.

To ensure an accurate positioning of the tab 1 on the containers **6*a*, 6*b***, it is advisable for the position of said containers to be just as accurate.

Provisions are made to this effect at the cutting level 19 for the containers **6*c* (FIG. 6) not to be entirely detached from the containers 6*e* immediately upstream, as by holding them in position by an uncut portion of their joint edge 34; for example, after a step forward during which the containers 6*c*, 6*d* have taken the position 6*a*, 6*b* where they receive the tabs, the containers 6*a*, 6*b*** are in a perfect position since they are still joined to the upstream containers.

They will be separated therefrom by the cutting tools of the station 19 which comprise means for cutting out the remaining portion (i.e. the joint side 35 corresponding to the side 34 moved one step forward).The containers are then free to be picked up by the belt 32 for storage or other purposes.

FIGS. 8 to 12 show a second embodiment of the piercing device 101 secured on the lid 102 of a container 103 of which the upper rim is joined, by welding for example, to the edge of the lid 102. The piercing device 101 is applied to the lids, which are tearable and which preferably cannot be easily detached from the container, even by peeling.

The piercing device 101 comprises a rigid upper tab 105 and a supple lower tab 106, one on top of the other, with substantially the same outline when seen in plan view (See FIG. 10). At its front part, the supple tab 106 is firmly secured to the corresponding part of the rigid tab 105 which forms the piercing arm. The area where the supple tab 106 is bonded with the rigid tab 105 is generally smaller than the free area of the rigid tab 105. The other face of the supple tab 106, i.e. the lower face, away from the rigid tab 105, is bonded, preferably over its entire surface, and anyway over a larger surface than the area by which the supple tab 106 is bonded with the rigid tab 105, to the lid 102, and particularly in a way such that the bonding area between the supple tab 106 and the rigid tab 105 faces towards the edge of the opening of the container 103.

Due to this type of bonding between the supple 106 and rigid 105 tabs and between the supple tab 106 and the lid 102, a piercing arm 107 is produced on the rigid tab 105 as well as a handling arm 108, which is preferably bigger than the piercing arm 107.

A pivoting axis 109 is thus provided at the inner rectilinear limit of the area by which the rigid 105 and the supple 106 tabs are bonded together, which limit is situated below the area by which the supple tab 106 is bonded with the lid 102, the pivoting axis being itself firmly secured both to the rigid tab 105 and to the supple tab 106 and as such to the lid 102. This permits the pivoting upwards of the handling arm 108 (see arrow F1, FIG. 9) and the pivoting downwards of the piercing arm 107, resulting in the latter tearing the lid 102. Then by pulling the handling arm 108 backwards in a more or less horizontal direction indicated by arrow F2, the lid can be torn off along an outline determined by the outline of the supple tab 106.

The material constituting the container or the rigid tab is not really important provided that it can be adequately bonded on the supple tab. The same applies with the materials constituting the lid and the supple tab, provided that said lid can be torn off by the rigid tab and that the supple tab can be firmly bonded to the rigid tab and to the lid and that said bond can withstand the different efforts applied.

When using the piercing device 101 with thermoshaped containers covered with lids made from aluminium sheets or strips or from a complex strip comprising a metallic film, it is advantageous to produce the rigid tab 105 from the thermoplastic strip used for the containers and the supple tabs 106 from the aluminium strip.

FIG. 10 shows a plan view of a portion of lid strip 110 covering the container strip. The opening 111 of the containers is shown in broken lines, the cutting lines 112 of the container rims with their sealed covers being shown in block lines. A plurality of containers joined together can be separated one from the other along score lines 113. The lid strip 110 is sealed over the rims of the containers in the annular areas 114 situated between the lines 112, 113 on the one hand, and the opening 111 on the other.

It is seen from FIG. 10 that the cutting lines 112 between four containers define a star-shaped intermediate area 115 which, in principle, constitutes wasted material. But according to a special feature of the invention, said intermediate area 115 is used for producing the assembly consisting of the rigid tab 105 and the supple tab 106. To this effect, the front part of the supple tab 106 (part of the aluminium strip with a thermo-adhesive film which is situated in the intermediate area 115) is sealed (under pressure and under heat) on the corresponding part of the container strip, subsequently constituting the rigid tab 105, said sealing operation being preferably carried out at the same time as the sealing together of the lids with the rims of the containers in the annular areas 114. The area 116 at which the supple tab 106 is sealed on the rigid tab 105 is hatched in the Figure and the inside limit of said area 116 is represented by a straight line 117 which extends perpendicularly to the longitudinal axis of the rigid tab 105.

After sealing part of the supple tab 106 on the rigid tab 105, the rigid tab 105 supple tab 106 assembly is cut along outline 118. After this, preferably the entire free face of the supple tab 106 is coated with adhesive with a view to applying said tab, the coated face down, on to the lid, preferably so that the pointed part (piercing arm 107) of the rigid tab is situated close to the opening 111 of the container. In other words, the external face of the lid and the external face of the supple tab 106 are bonded together back to back, which faces were in the same plane and on the same side in the lid strip 110 before the cutting of the rigid 105 and supple 106 tabs (see reference 119 in FIG. 12).

The installation for producing the piercing device 101 comprises the means mentioned hereinabove which are obviously adapted to the shape of the tabs and to where they are applied.

It is easy to understand that the sealing area 116 corresponds to the area of the rigid tab 105 which forms the piercing arm 107 and that the straight line 117 will subsequently constitute the straight pivoting line 109 when the piercing device is fixed on the lid 102 of the container 103.

Figure 11:
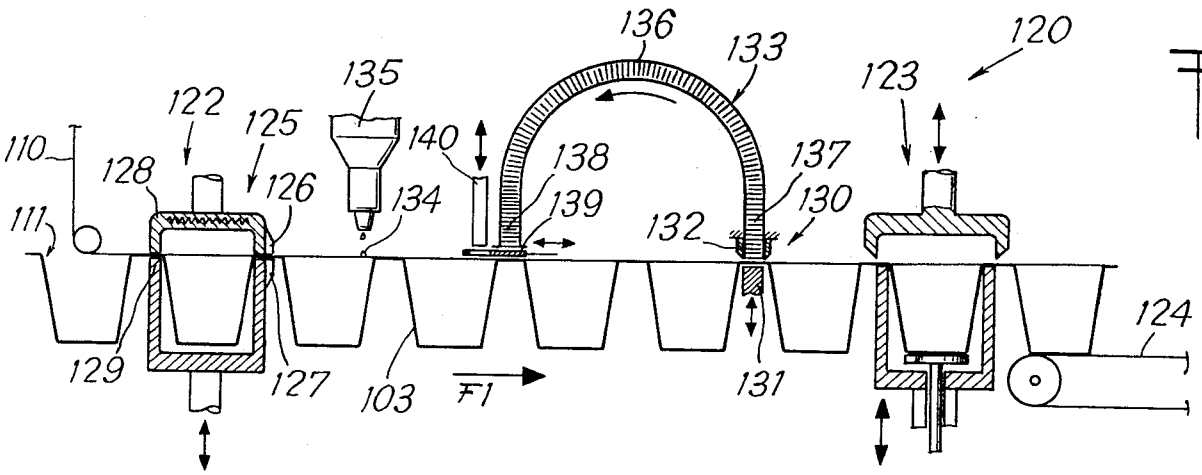
FIG. 11 is a diagrammatical side view of an installation for producing the second embodiment of the piercing device according to the invention.
Figure 12:
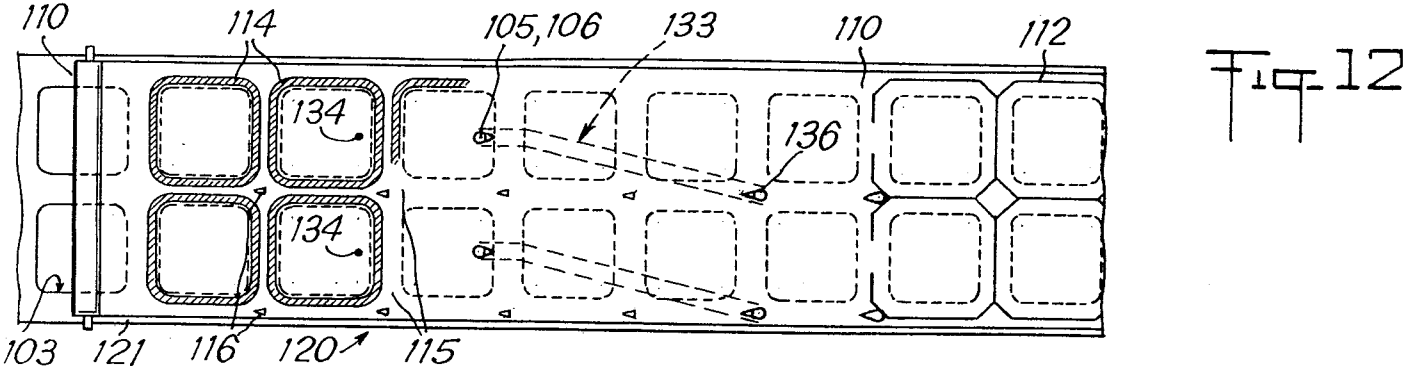
FIG. 12 is a view from above of the installation according to FIG. 11.

FIGS. 11 and 12 illustrate an installation for producing a piercing device according to the invention, said installation being combined with, or preferably incorporated in, a packing installation 120 of the type wherein containers 103 are thermo-shaped from a thermoplastic strip 121, and wherein said containers are filled with a product and sealed when filled by means of a supple lid strip 110, and wherein the filled and sealed containers 103 are cut from the said thermoplastic strip 121 and from the lid strip 110. The packaging installation 120 is of known structure and will not need to be described here in detail. Said installation 120 comprises, successively, a station, not shown, where the thermoplastic strip 121 is heated, a thermo-shaping station, not shown, where cells are produced to constitute the containers 103 which remain attached to the strip 121, a filling station where the containers 103 are filled with a product, a sealing station 122 where the lid strip 110, previously deposited over the thermoplastic strip 121 so as to cover the openings 111 of the containers 103 and the rims thereof, is heat-sealed under pressure, along annular sealing areas 114 on said rims, and a cutting station 123 where the sealed containers 103 and cut either individually or in groups, from the thermoplastic strip 121 and from the lid strip 110 outside the sealing areas 114, and along cutting lines 112 before being removed by way of a conveyor belt 124, for example, towards an overall-packaging station, not shown.

In the illustrated case, the thermoplastic strip 121 for the containers and the lid strip 110 are adantageously used for the two-arm lever system comprising the rigid tab 105 and the supple tab 106, whenever large enough intermediate areas 15 are left between the sealing areas 114 of several adjacent containers and belonging to two successive rows of containers. Of course, it will also be possible to produce the lever assembly constituted by a rigid tab 105 and a supple tab 106 by using two superimposed strips one of which is a rigid material, and the other a supple, foldable and thermo-sealable material i.e., a material capable of being sealed under heat and pressure on the rigid thermoplastic strip.

As can be seen in FIGS. 11 and 12, the installation for producing the piercing device comprises sealing means 125 with a heated upper punch 126 and a lower counter-punch 127, both of which have working faces of identical configuration to that of the sealing areas 116 of the tabs 105 and 106 (see also FIG. 10). In the case of the embodiment illustrated in FIGS. 10 to 12, the punches 126 and counter-punches 127 are provided in the sealing station 122 and carried respectively by the punches 128 and counter-punches 129 used for sealing the lid strip 110 over the thermoplastic container strip 121 along annular areas 114.

The assemblies consisting of the rigid tabs 105 and supple tabs 106 are then cut either from the aforesaid pair of strips or from the assembly of superimposed strips constituted by the container strip 121 and by the lid strip 110, this cutting operation being effected around the predetermined design 118 of the two superimposed tabs 105, 106 and in such a way that the sealing area 116 of each pair of tabs 105, 106 is situated at right angles with the piercing arm 107 and separated from the unsealed area by the dividing straight line 117 which will subsequently provide the pivoting axis 109 of the piercing device. The cutting of the superimposed and partly thermo-sealed together tabs 105, 106 is carried out with cutting means 130 of the type comprising a cutting punch 131 and a fixed bottomless die 132 disposed on either sides of the pair of superimposed strips 110, 121. The pairs of cut tabs 105, 106 are discharged through the bottom of the dies 132 into conveyor means 133 constituted either by removable storage cartridges, or by guiding slides. When the pairs of tabs 105, 106 are cut from two superimposed strips, they are stored in cartridges connected to the open bottom of the dies 132 and provided, preferably, with a return spring for subsequently helping the release one by one of the pairs of tabs 105, 106 above a predetermined part of a plane lid 102 sealed on the rims of the corresponding container 103, the predetermined part having been coated beforehand with a minute layer or with a drop of adhesive 134 by an appropriate adhesive dispenser 135.

In the case of the embodiment illustrated in FIGS. 11 and 12 the die 132 is placed above the pair of strips 110, 121 and the corresponding punch 131 is placed underneath said pair of strips in the predetermined parts for cutting the pairs of tabs 105, 106. The cutting means 130 can be provided either in the station 123 where the sealed containers are cut or a step or more forward of the strip upstream of said station 123, a step forward of the strip being equal to the width of a cut container, width taken in the forward direction $F_1$ of the pair of strips 110, 121. Of course the punches are controlled in a synchronous manner with the cutting elements of the station 123.

In the illustrated case, the guiding slides 133 can be made up by tubes of cross-section adapted to the configuration of the pairs of tabs 105, 106 and shaped so as to have a semi-circular middle part 136 and two vertical lateral parts 137, 138, of which one (137) issues by its lower end above the bottom of the die 132, the other lateral part (138) being closed off at its lower end by a sliding plate 139 of a known type with an aperture (of the type used for example in slide projectors) and being disposed near the part where a pair of tabs 105, 106 is deposited on the area of the lid previously coated with adhesive. Said sliding plate 139 is in a horizontal position and separated from the lid strip 110 by a distance slightly greater than the thickness of one pair of tabs 105, 106, which pair has been turned over 180° during its transfer into the guiding slide 133. When the aperture portion of the sliding plate 139 is drawn out sideways from the guiding slide 133, the aperture portion comes under an applicator piston 140 which, after pushing a pair of tabs 105, 106 out of said aperture where it was held by elastic means gripping its edges, applies it against the area of the lid strip 110 previously coated with adhesive which area is plumb with the opening of a container 103. It will be noted in FIGS. 10 and 11 that the sealing means 125, the adhesive-coating means 135 and the means used for applying the pairs of tabs 105, 106 are placed one behind the other (with the appropriate lateral shifting) in the forward direction of the strips 110, 121 and that the cutting means 130 are situated downstream of the application means 140. When the guiding slide 133 is entirely filled with pairs of tabs 105, 106, each cutting movement of the punch 131 will automatically introduce a pair of tabs 105, 106 into the aperture of the sliding plate 139 at the other end of the guiding slide 133. It is to be further noted that the type of guiding slide 133 which cooperates at one end with the open bottom of a cutting die and at the other end with a sliding plate with aperture 139, can also be used when the cutting means 130 do not cooperate with a pair of strips 110, 121, but instead with a pair of tapes independent of the said pair of strips. This could for example be the case when the free areas 115 between the rims of the containers 103 are too small to allow the pairs of tabs 105, 106 to be cut therefrom.

What is claimed is:

1. A method for providing with piercing tabs the lids of containers which are thermoshaped from a thermoplastic strip and closed by said lids, said lids being produced from a lid strip of a supple and tearable material which is superimposed on said thermoplastic strip of containers and thermobonded on the rims of said containers, said thermoplastic strip having container-shaping areas and free areas outside said shaping areas, and said tabs piercing said lids by a leverage effect, which method comprises the steps of:

cutting substantially plane rigid tabs, from said free areas of said thermoplastic strip used for the production of said thermo-shaped containers;

providing on said tabs pivoting axes which divide said tabs into a piercing arm and a handling arm; and securing said pivoting axes on said lids when said lids are in a closing position on said containers.

2. A method as claimed on claim 1, wherein the step of providing on said tabs pivoting axes is accomplished by forming a rib on each tab and the step of securing said pivoting axes is accomplished by fixing said tabs by said ribs on said lids.

3. A method as claimed in claim 1, wherein the step of providing on said tabs pivoting axes comprises thermo-bonding said lid strip to said thermoplastic strip at portions of said free areas which subsequently form said piercing arms of the rigid tabs, wherein the step of cutting substantially plane rigid tabs comprises cutting assemblies of rigid and supple tabs which contain said thermo-bonded portions of said free areas from said superimposed strips, and wherein the step of securing said pivoting axes on said lids comprises bonding said assemblies by their supple tabs on said lids.

4. A method as claimed in claim 1, wherein the thermoplastic strip and lid strip are advanced in steps and wherein, after each forward step of said thermoplastic strip and said lid strip, said lid strip is thermo-bonded to said thermoplastic strip at a first station, the bonding being effected on the rims of said containers and also, to accomplish the step of providing on said tabs pivoting axes, on portions of said free areas which subsequently form said piercing arms, wherein the step of securing said pivoting axes on said lids is accomplished at a second station by depositing a small quantity of adhesive on one of said lids of said containers and the part of the supple tabs thermo-bonded to said rigid tabs, and at a third station by depositing bonded assemblies of one rigid tab and one supple tab on said lids in such a way that the area of the supple tab which corresponds to said piercing arm is bond by said adhesive to said lid, and wherein the step of cutting substantially plane rigid tabs is accomplished at a fourth station by cutting such assemblies of rigid and supple tabs with a view to transferring them towards the third station, and further comprising cutting said containers from the superimposed strip at a fifth station.

5. A method as claimed in claim 1, wherein the step of providing on said tabs pivoting axes comprises supplying said rigid tabs with supple tabs having about the same extension as said rigid tabs, and securing each supple tab by one face thereof to a rigid tab solely on the side of said piercing arm, and wherein the step of securing said pivoting axes comprises securing the other faces of the supple tabs to said lids at least on the side of said handling arms of said rigid tabs.

6. A method as claimed in claim 5, wherein said supple tabs are produced of a supple and thermosealing composite material, wherein the step of securing each supple tab by one face thereof to a rigid tab is accomplished by thermo-bonding, and wherein the step of securing the other faces of said supple tabs comprises securing said other faces to said lids by adhesive bonds.

7. An installation for producing a device for piercing the lids of thermoplastic containers by leverage, each of said lids being produced of supple and tearable material and being thermo-bonded on the rim of one of said containers, wherein said installation is associated with a packaging machine of the type which thermo-shapes containers from a thermoplastic strip, fills the containers with a product, thermo-seals the containers with a lid strip, and finally cuts the sealed containers from said thermoplastic strip and from said lid strip, said installation comprising:

means for producing substantially plane and rigid thermoplastic tabs; means for thermoforming ribs on said rigid tabs to provide on each rigid tab a pivoting axis dividing said tab into a piercing arm and a handling arm; means for cutting said tabs out of said thermoplastic strip; and means for securing said pivoting axes on said lids of said thermoplastic containers, said means for securing including adhesive-dispensing means for applying adhesive to said lids, means for transferring said tabs from said cutting means to the adhesive coated areas of said lids of said containers, and means for applying said tabs on said lids.

8. An installation for producing a device for piercing the lids of thermoplastic containers by leverage, each of said lids being produced of supple and tearable material and being thermo-bonded on the rim of one of said containers, wherein said installation is associated with a packaging machine of the type which thermo-shapes containers from a rigid thermoplastic strip, fills the containers with a product, thermoseals the containers with a supple and tearable lid strip, and finally cuts the sealed containers, said installation comprising:

means for producing substantially plane and rigid thermoplastic tabs each having a pivoting axis dividing the tab into a piercing arm and a handling arm, said means including means for thermo-sealing said supple lid strip on said rigid thermoplastic strip in areas situated between adjacent containers and corresponding subsequently to said piercing arms of said different rigid tabs; cutting station means for cutting out of the superimposed strips, in areas situated between adjacent containers, assemblies of superimposed rigid and supple tabs previously sealed together; means for transferring the cut and sealed assemblies of rigid and supple tabs from said cutting station means to a station where said assemblies are placed on said lids of said sealed containers; and means for securing said pivoting axes to said lids of said containers, said means for securing including means for adhesively coating one of the free faces of the supple tabs and the areas of the lids which are positioned to receive the assemblies of one rigid tab and one supple tab, and means for applying each assembly on a corresponding lid so that the free face of the supple tab is firmly bonded to said lid.

* * * * *